US007518562B2

(12) United States Patent
Chen et al.

(10) Patent No.: US 7,518,562 B2
(45) Date of Patent: Apr. 14, 2009

(54) ANTENNA COMBINING EXTERNAL HIGH-BAND PORTION AND INTERNAL LOW-BAND PORTION

(75) Inventors: Kuo-Cheng Chen, Taoyuan Hsien (TW); Chung-I Chou, Taoyuan Hsien (TW); Kuei-Chiang Huang, Taoyuan Hsien (TW)

(73) Assignee: HTC Corporation, Taoyuan (TW)

( * ) Notice: Subject to any disclaimer, the term of this patent is extended or adjusted under 35 U.S.C. 154(b) by 170 days.

(21) Appl. No.: 11/511,579

(22) Filed: Aug. 29, 2006

(65) Prior Publication Data

US 2007/0063904 A1 Mar. 22, 2007

(30) Foreign Application Priority Data

Sep. 19, 2005 (TW) ..... 94132321 A

(51) Int. Cl.
*H01Q 1/24* (2006.01)

(52) U.S. Cl. ..... 343/702; 343/700 MS

(58) Field of Classification Search ..... 343/702, 343/700 MS, 895

See application file for complete search history.

(56) References Cited

U.S. PATENT DOCUMENTS

| | | | | |
|---|---|---|---|---|
| 2002/0175866 | A1 | 11/2002 | Gram | |
| 2005/0259031 | A1 * | 11/2005 | Sanz et al. | 343/895 |
| 2007/0046548 | A1 * | 3/2007 | Pros et al. | 343/702 |
| 2007/0080871 | A1 * | 4/2007 | Ying | 343/702 |
| 2007/0120740 | A1 * | 5/2007 | Iellici et al. | 343/700 MS |

FOREIGN PATENT DOCUMENTS

| | | |
|---|---|---|
| EP | 1168491 | 1/2000 |
| EP | 1248317 | 3/2002 |
| WO | WO99/67851 | 12/1999 |
| WO | WO03/047026 | 6/2003 |
| WO | WO2004/057701 | 7/2004 |

* cited by examiner

*Primary Examiner*—HoangAnh T Le
(74) *Attorney, Agent, or Firm*—Occhiuti Rohlicek & Tsao LLP

(57) ABSTRACT

An antenna comprises an external high-band portion and an internal low-band portion. The external high-band portion reduces energy dissipation from nearby components, and the internal low-band portion reduces the phantom head effect. The antenna combines the external high-band portion and the internal low-band portion, utilizing the advantages of the two portions to benefit the receiving efficiency of the antenna.

16 Claims, 2 Drawing Sheets

ANTENNA COMBINING EXTERNAL HIGH-BAND PORTION AND INTERNAL LOW-BAND PORTION

RELATED APPLICATIONS

The present application is based on, and claims priority from, Taiwan Application Ser. No. 94132321, filed Sep. 19, 2005, the disclosure of which is hereby incorporated by reference herein in its entirety.

BACKGROUND OF THE INVENTION

1. Field of Invention

The invention relates to an antenna and, in particular, to an antenna that can reduce energy dissipation from nearby components and phantom head effect.

2. Related Art

With technological advances, the primary hotbed of communication techniques has gradually shifted from wired communications to wireless communications, as can be seen from their popularity in wireless home electronics and mobile phones. The transmitting medium of choice has changed from conventional metal wires (such as coaxial cables) to air. Antennas are the key component of wireless communication devices for sending and receiving electromagnetic (EM) signals. That is, a wireless communication device needs to have an antenna in order to send or receive EM waves. Therefore, the antenna is an indispensable component in wireless communication devices.

In conventional wireless communication devices, most antennas are external. In recent years, with the rapid advances of mobile technology, more antennas have become internal.

Nevertheless, both external and internal antennas have their drawbacks in transmitting and receiving signals. For example, external antennas experience the phantom head effect at low frequencies and thus have large efficiency loss. Internal antennas have serious energy dissipation when in close proximity to components such as microphones or cameras.

It is therefore desirable to provide an antenna that can solve the aforementioned problems simultaneously.

SUMMARY OF THE INVENTION

An objective of the invention is to provide an antenna not only for reducing energy dissipation caused by internal components at high frequencies but also for reducing efficiency loss caused by the phantom head effect at low frequencies.

According to a preferred embodiment of the invention, a high-band portion and a low-band portion of an antenna are separately formed and disposed on an antenna case. The high-band portion is exposed outside the antenna case to avoid the energy dissipation at high frequencies due to nearby components. The low-band portion is hidden inside the antenna case to reduce the efficiency loss at low frequencies due to the phantom head effect. Therefore, the invention can solve the conventional problems described above.

According to another embodiment of the invention, a high-band portion and a low-band portion are separately formed and disposed on an antenna case. In addition, the high-band portion is bent so that it is completely hidden inside the antenna case, and a clearance area is formed in the antenna case to keep the high-band portion from the grounded surface of the substrate by an appropriate distance. Therefore, the antenna is prevented from being damaged as a result of being exposed to the environment.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
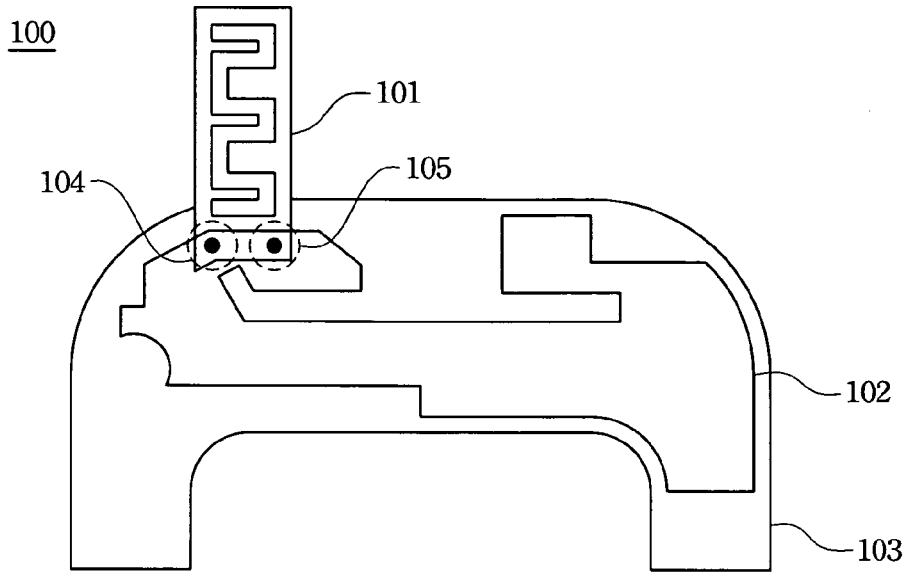
FIG. 1A shows an antenna according to a preferred embodiment of the invention.

FIG. 1A shows an antenna 100 according to a preferred embodiment of the invention. The antenna 100 includes a high-band portion 101, a low-band portion 102, and an antenna case 103.

In this embodiment, the high-band portion 101 is a meander-line antenna exposed outside the antenna case 103. The low-band portion 102 is a planar inverted-F antenna (PIFA) hidden inside the antenna case 103. The high-band portion 101 is coupled to the low-band portion 102 and has a feeding point 104 and a ground point 105. The feeding point 104 is coupled to a RF (radio frequency) module 140 disposed on a substrate 120 of the system, as shown in FIG. 1B.

Figure 1B:
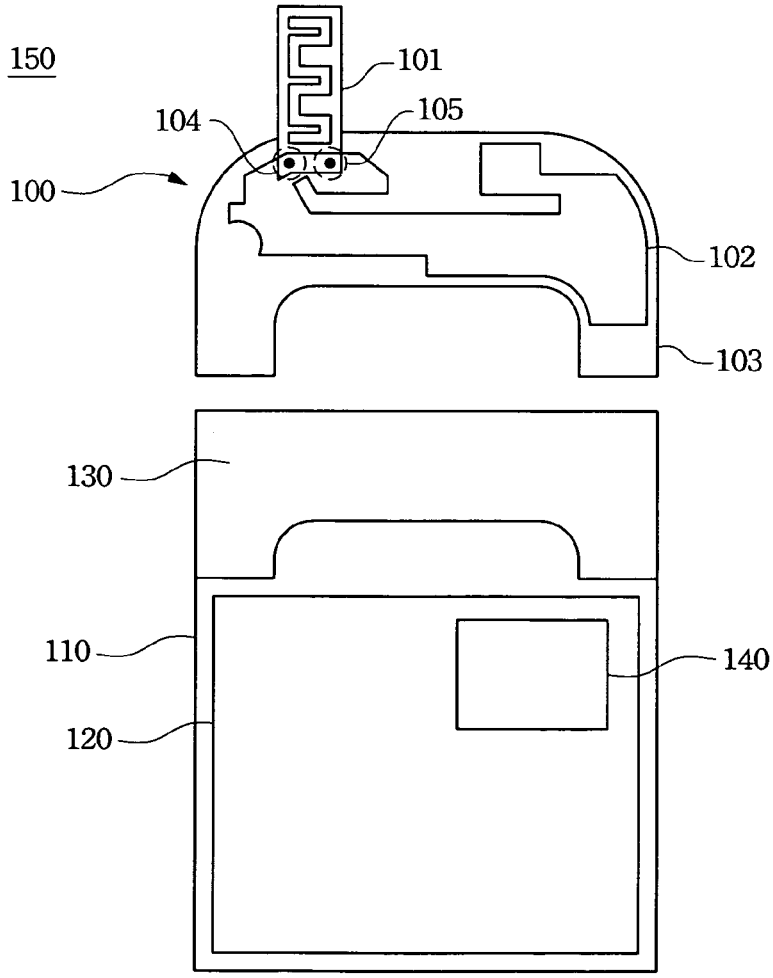
FIG. 1B shows a wireless communication device using the antenna of FIG. 1A.

FIG. 1B shows a wireless communication device 150 using the antenna 100 of FIG. 1A. The wireless communication device 150 includes an antenna 100, an antenna installation region 130, a substrate 120, and a housing 110. When the antenna 100 is mounted to the housing 110, the antenna 100 is disposed in the antenna installation region 130, away from other components on the substrate 120. The high-band portion 101 is exposed outside the substrate 120 of the wireless communication device 150.

As shown in FIG. 1B, the high-band portion 101 is used to transmit and receive high-frequency signals and can prevent energy dissipation caused by nearby components, such as microphones and cameras, at high frequencies. The low-band portion 102 is used to transmit and receive low-frequency signals and can prevent efficiency loss due to the phantom head effect.

Figure 2A:
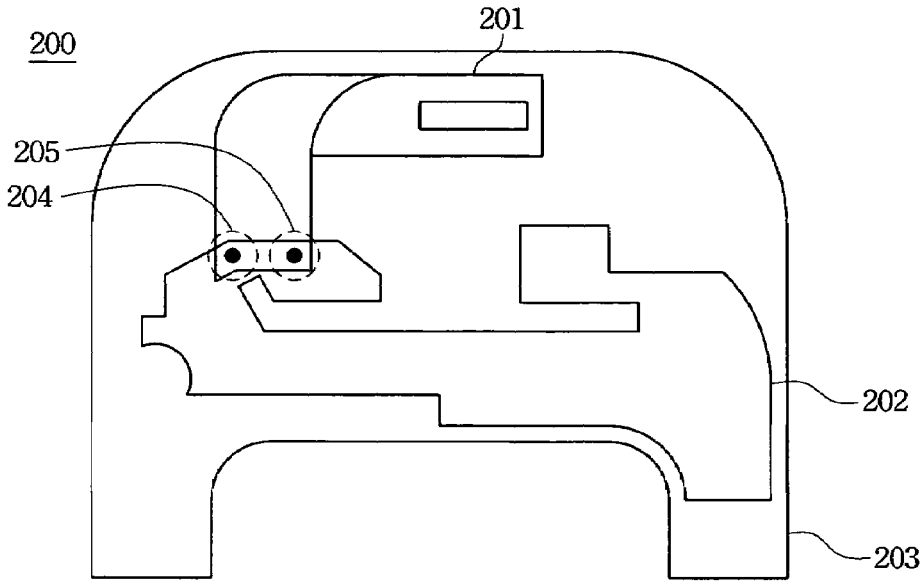
FIG. 2A shows an antenna according to another embodiment of the invention.

FIG. 2A shows the antenna 200 according to another embodiment of the invention. The antenna 200 includes a high-band portion 201, a low-band portion 202, and an antenna case 203.

Figure 2B:
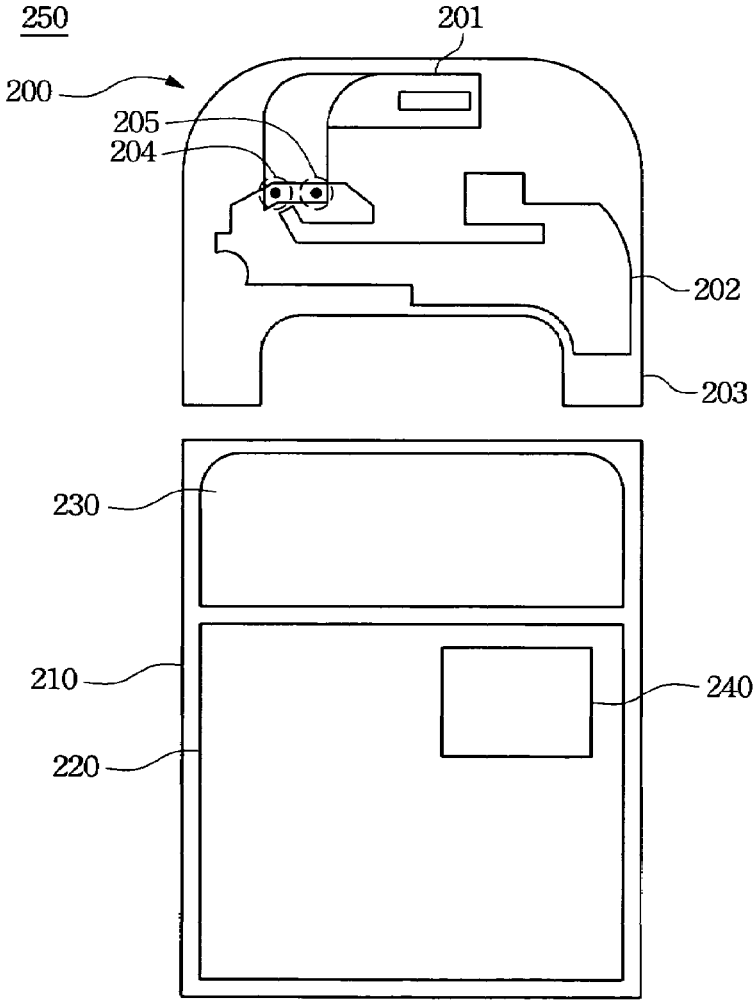
FIG. 2B shows a wireless communication device using the antenna of FIG. 2A.

In this embodiment, the high-band portion 201 is an inverted-F antenna (IFA), and the low-band portion 202 is a PIFA. The high-band portion 201 and the low-band portion 202 are coupled to share the same feeding point 204 and ground point 205. The feeding point 204 is coupled to a RF module 240 disposed on a substrate 220 of the system, as shown in FIG. 2B. The low-band portion 202 is disposed on the antenna case 203, and the high-band portion 201 has a turning portion.

FIG. 2B shows a wireless communication device 250 containing the antenna 200 of FIG. 2A. The wireless communication device 250 includes an antenna 200, an antenna installation region 230, a substrate 220, and a housing 210. When the antenna 200 is mounted to the housing 210, the antenna 200 is disposed in the antenna installation region 230, away from other components on the substrate 220.

In comparison with FIG. 1A, the high-band portion 201 in this embodiment is hidden inside the case 203 of the antenna 200. However, a clearance area is required for the high-band portion 201 to keep an appropriate distance from the grounded surface of the substrate. This embodiment thereby achieves the same effects as in the first embodiment. Moreover, not only does this embodiment prevent the antenna from being damaged as a result of being exposed to the environment, but it also reduces additional complications in circuit design and inconvenience in carrying. In addition, the entire case of the wireless communication device can keep its integrity, and the antenna has a longer lifetime.

The disclosed antenna can simultaneously prevent efficiency loss caused by nearby components and the phantom head effect. Combining the aforementioned advantages, the disclosed antenna can be widely applied to future wireless communication devices.

It should be emphasized that the antennas in the above-mentioned embodiments are only examples of the invention and thus should not be used to restrict the types of antennas in the invention. For example, the high-band portion of the invention may be a spiral antenna, IFA, or meander-line antenna.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An antenna for a wireless communication device including a substrate and a radio frequency module disposed on the substrate, comprising:

an antenna case;

a high-band portion disposed on the antenna case and external to the substrate;

a low-band portion coupled to the high-band portion and received entirely within the antenna case, wherein the high-band portion is located farther from the substrate than the low-band portion and a feeding point coupling the high-band portion and the low-band portion to the radio frequency module.

2. The antenna of claim 1, wherein the high-band portion is exposed outside the antenna case.

3. The antenna of claim 1, wherein the high-band portion is hidden inside the antenna case.

4. The antenna of claim 1, wherein the high-band portion is a meander-line antenna.

5. The antenna of claim 1, wherein the high-band portion is an inverted-F antenna (IFA).

6. The antenna of claim 1, wherein the high-band portion is a spiral antenna.

7. The antenna of claim 1, wherein the low-band portion is a planar inverted-F antenna (PIFA).

8. The antenna of claim 1, wherein the low-band portion is a planar antenna.

9. A wireless communication device, comprising:

a substrate having a radio frequency module disposed thereon; and an antenna including:

an antenna case;

a high-band portion disposed on the antenna case and away from the substrate;

a low-band portion coupled to the high-band portion and totally received in the antenna case, wherein the high-band portion is located farther from the substrate than the low-band portion and a feeding point coupling the high-band portion and the low-band portion to the radio frequency module.

10. The wireless communication device of claim 9, wherein the high-band portion is exposed outside the antenna case.

11. The wireless communication device of claim 9, wherein the high-band portion is hidden inside the antenna case.

12. The wireless communication device of claim 9, wherein the high-band portion is a meander-line antenna.

13. The wireless communication device of claim 9, wherein the high-band portion is an inverted-F antenna (IFA).

14. The wireless communication device of claim 9, wherein the high-band portion is a spiral antenna.

15. The wireless communication device of claim 9, wherein the low-band portion is a planar inverted-F antenna (PIFA).

16. The wireless communication device of claim 9, wherein the low-band portion is a planar antenna.

* * * * *